US006656094B2

(12) United States Patent
Rigas

(10) Patent No.: US 6,656,094 B2
(45) Date of Patent: Dec. 2, 2003

(54) MODULAR COMPONENT, ARM, LEG, AND BODY STRETCHING DEVICE

(76) Inventor: Peter E. Rigas, 1419 Wayne Cir., Yardley, PA (US) 19067

( * ) Notice: Subject to any disclaimer, the term of this patent is extended or adjusted under 35 U.S.C. 154(b) by 141 days.

(21) Appl. No.: 10/022,449

(22) Filed: Dec. 17, 2001

(65) Prior Publication Data

US 2003/0114279 A1 Jun. 19, 2003

(51) Int. Cl.[7] ..... A63B 21/00
(52) U.S. Cl. ..... 482/131; 482/91
(58) Field of Search ..... 602/36, 4, 33, 602/32, 18; 601/39; 482/131, 91, 907; 242/375.1, 377, 380; 606/241

(56) References Cited

U.S. PATENT DOCUMENTS 2,282,653 A * 5/1942 Herzmark ..... 242/375.1
2,844,143 A * 7/1958 Swanson ..... 602/36
4,132,404 A 1/1979 Wilson
4,314,697 A 2/1982 Brumfield et al.
4,666,154 A 5/1987 Lipscomb et al.
4,687,197 A 8/1987 Larsson et al.
5,261,868 A 11/1993 Pryor et al.
5,324,245 A * 6/1994 Fontana ..... 482/142
5,451,202 A * 9/1995 Miller et al. ..... 602/235
5,762,592 A 6/1998 Neveux
6,467,713 B1 * 10/2002 Watanabe et al. ..... 242/375.1

* cited by examiner

*Primary Examiner*—Jerome W. Donnelly
(74) *Attorney, Agent, or Firm*—Kenneth P. Glynn, Esq.

(57) ABSTRACT

The present invention is a modular component leg, arm, and body-stretching device. It includes a main ratchet component having a handle and at least one ratchet bar functionally connected to and capable of passing through the handle. The handle contains a directional ratchet-up mechanism and a trigger wherein when the trigger is depressed, the ratchet bar(s) advance toward the handle. The handle also has a release mechanism to release the ratchet bar from the ratchet-up mechanism. The ratchet bar has an auxiliary component attachment at one end thereof for attachment, directly or indirectly, if a foot or hand auxiliary component. The foot auxiliary component is for leg and body exercise, and has a rigid base for placement of a foot thereon, having a foot securing mechanism to hold a foot in place. There is also at least one attachment for connection with the ratchet bar. The hand auxiliary component is also attachable to of the ratchet bar, for arm and body exercises, and includes a handle for placement of a hand thereon and having at least one main ratchet component attachment mechanism for attachment to the ratchet bar. There may also be a yoke for connection between the main component and the auxiliary components.

20 Claims, 4 Drawing Sheets

MODULAR COMPONENT, ARM, LEG, AND BODY STRETCHING DEVICE

BACKGROUND OF THE INVENTION

1. Field of the Invention

The present invention relates to exercise devices for arm, leg, and body stretches. More specifically, the present invention relates to a modular component device which contains a main ratchet component and separate foot and hand components which are removeably attachable to the main ratchet component. Thus, a user may rely upon the same physical mechanism to perform leg and body stretches and arm stretches by interchanging the other modular components.

2. Information Disclosure Statement

The following patents are representative of the state of the art for leg, arm, and body stretching devices:

U.S. Pat. No. 5,762,592 describes a leg multi-muscle stretch apparatus for physical therapy that includes a foot carriage mounted to a carriage guide track and permitting the foot carriage to move back and forth along a foot carriage path, for therapeutically stretching a user foot and user leg with reciprocating motion, and a user support structure pivotally connected the carriage track. The apparatus preferably additionally includes user handle grips and two elongate arm members pivotally connected to the carriage guide track, where the handle grips are connected to the elongate arm members. The user support structure preferably includes a platform structure including two parallel and laterally spaced apart beam members and a planar web member extending between and supported by the beam members. The apparatus preferably additionally includes two cable and cable pulley mechanisms, each including a series of cables forming a cable loop extending along the user support structure, along the carriage guide track and along the arm members, and then back to the user support structure, and a series of pulleys rotatably mounted to the user support structure and to the carriage guide track for guiding the cable loop being connected to the foot carriage to reciprocate with the foot carriage.

U.S. Pat. No. 5,261,868 describes an exercise device including an elongated upright ladder section which has at an upper end a body support section. There is a base adapted to rest on a horizontal surface and support in a stable, vertical orientation the upright section. The body support section includes a seat rest support member oriented substantially horizontally and adapted to be sat upon by a user and a second support member spaced from the seat rest support member and adapted to be gripped by the user with either legs or hands depending on the exercise being performed. A generally flat, planar, back support has its upper end pivotally mounted to the seat rest support member and a lower free end movable between a first position where the back support is generally vertical and a second position where the back support pivots and is at an acute angle with respect to the upright section.

U.S. Pat. No. 4,687,197 describes the present invention that relates to exercise equipment, more particularly to an exercise machine that gives the exerciser a variety of movements based on a single concept (that of the pivot), working the whole body without having to change equipment. The apparatus includes a frame having a seat, a vertically extending rod pivotally coupled to the frame and a handle pivotally coupled to the end of the rod. The dual pivoting connections facilitate an exercise movement similar to the paddling motion used with a kayak.

U.S. Pat. No. 4,666,154 describes an exercise device that has two side bars each comprising a longitudinal segment extending between front and rear legs. The angle and length of the front and rear legs produces an incline of the longitudinal segment. The angle of incline is variable because the front and rear legs are separately adjustable in length. Slip locks selectively lock each leg at a desired length. Cross bars connected between the side bars by quick release locks. A central longitudinal bar parallel to the side bars extends between a selected two of the cross bars and is connected thereto by quick release locks.

U.S. Pat. No. 4,314,697 describes a physical exercising device that is provided compromising a padded wedge-shaped base and a string-biased metal exercise bar. The exercise bar is attached near the wedge's apex and extends lengthwise parallel to the device at a predetermined distance from the wedge. The physical exercising device has its base formed from a lightweight material and additionally may have its body support surfaces covered with a layer of carpet or foam padding. The spring which has its one end attached to the exercise bar has its opposite end secured to the end panel of the wedge-shaped base to provide a biasing force. The ends of the metal bar are inserted through apertures in the end panel and terminate in the interior of the physical exercising device. The exercise bar may be of a unitary piece of tubular metal or a single metal tube with two gripping portions which may or my not be independently operable.

U.S. Pat. No. 4,132,404 describes a leg stretching exercise device which has two platforms, each adapted to support a foot of an exerciser. Each platform is provided with ball casters which provide support and allow free movement in a mutual plane. The platforms are attached so they may be placed in touching relationship and moved apart a predetermined distance by the exerciser. A rope connects a single point on each platform. The connecting rope defines a loop which passes through eyelets, secured to each platform. An adjustable connection is provided for varying the size of the loop as desired.

Notwithstanding the prior art, the present invention is neither taught nor rendered obvious thereby.

SUMMARY OF THE INVENTION

The present invention is a modular component leg, arm, and body-stretching device. It includes a main ratchet component having a handle and at least one ratchet bar functionally connected to and capable of passing through the handle. The handle contains a directional ratchet-up mechanism and a trigger wherein when the trigger is depressed, the ratchet bar(s) advance toward the handle. The handle also has a release mechanism to release the ratchet bar from the ratchet-up mechanism. The ratchet bar has an auxiliary component attachment at one end thereof for attachment, directly or indirectly, if a foot or hand auxiliary component. The foot auxiliary component is for leg and body exercise, and has a rigid base for placement of a foot thereon, having a foot securing mechanism to hold a foot in place. There is also at least one attachment for connection with the ratchet bar. The hand auxiliary component is also attachable to of the ratchet bar, for arm and body exercises, and includes a handle for placement of a hand thereon and having at least one main ratchet component attachment mechanism for attachment to the ratchet bar. There may also be a yoke for connection between the main component and the auxiliary components.

In some embodiments of the present invention, there is only a main ratchet component with either an auxiliary foot component or an auxiliary hand component, while in other embodiments, both an auxiliary foot component and an auxiliary hand component are included.

In some embodiments of the present invention, the security means of the foot auxiliary component is a toe attachment means located on a front area of the rigid base. On other embodiments of the present invention modular component leg and body stretching device the securing means of the foot auxiliary component is two separate side attachment means, one being located on a first side of the rigid base and another being located on a second side of the rigid base, and located opposite one another. On preferred present invention embodiments, the toe and the two-side attachment means are all included.

On some preferred present invention embodiments, there is a yoke having three separate elongated members, each having a first and a second end and being connected to one another at the first end and having means for attachment to the main ratchet component the first end, and each being unconnected to one another at its second end.

BRIEF DESCRIPTION OF THE DRAWINGS

The present invention should be more fully understood when the specification herein is taken in conjunction with the drawings appended hereto wherein.

DETAILED DESCRIPTION OF THE PRESENT INVENTION

Figure 1:
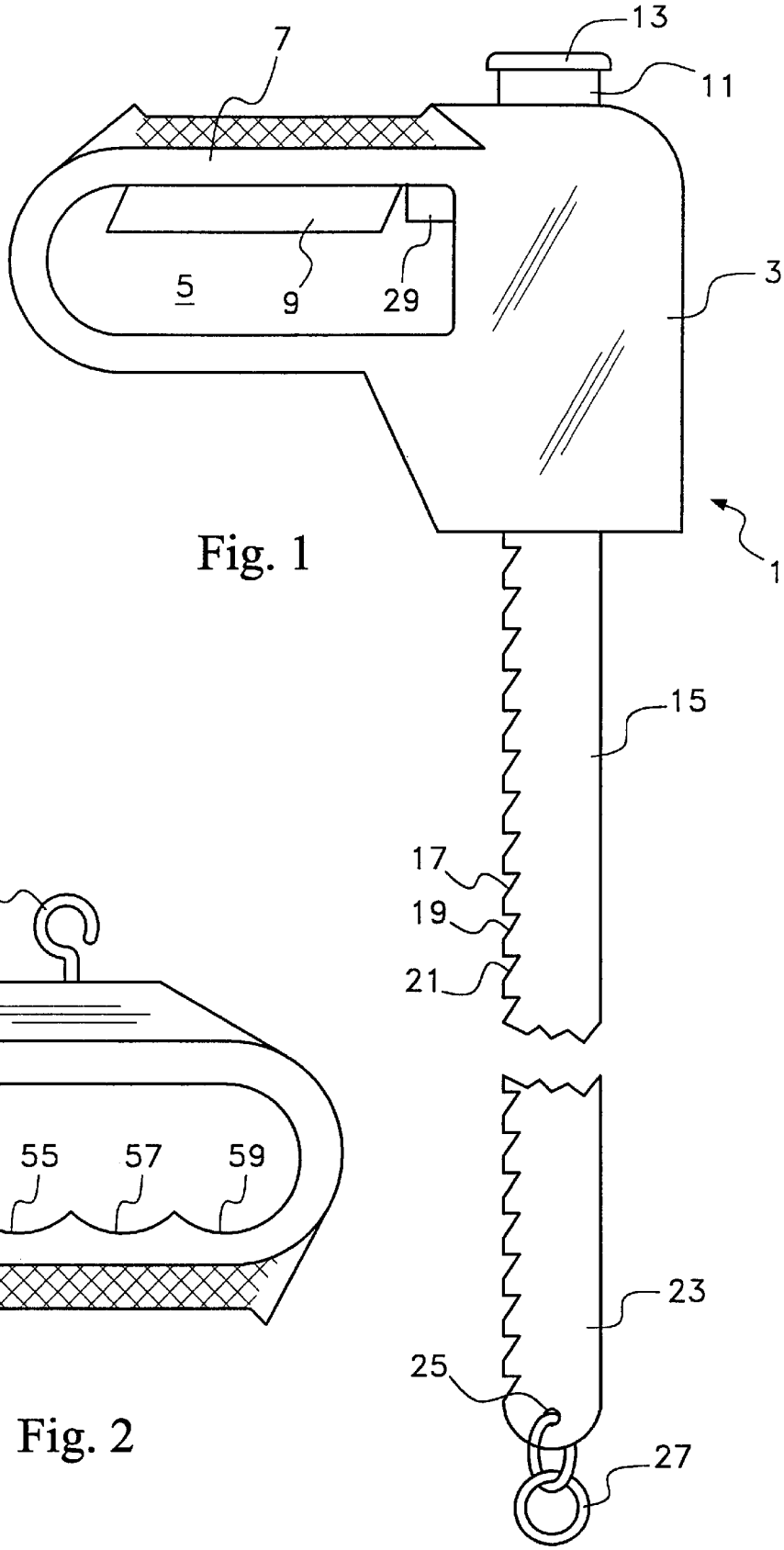
FIG. 1 shows a front view of one preferred embodiment of a main ratchet component of a present invention modular component leg, arm, and body stretching device.

Referring now to FIG. 1, there is shown a present invention modular component stretching device main ratchet component 1. This is the functional element of the present invention and figure one shows a single bar preferred embodiment. Thus, main ratchet component 1 includes a housing 3 with a handle 7 and an open area 5 for passing a users fingers through. Thus, handle 7 is grasped with the fingers curled toward the palm area when in use.

There is a single one way ratchet bar 15 which passes through housing 3. Ratchet bar 15 has a protective stop 13 at 1 and 11. Ratchet bar 15 also has a plurality of one way ratchet notches such as ratchet notches 17,19, and 27. As its second end 23 is an orifice 25 and attachment ring 27, comprising an auxiliary component attachment means. This is used to attach foot auxiliary components for led and body stretching exercises as well as hand auxiliary components for arm and body stretching exercises.

Ratchet-up mechanism squeeze bar 9 is utilized to advance ratchet bar 15 so as to move second end 23 toward housing 3. Release button 29 is used to unlock ratchet bar 15 so that second end 23 may be pulled away from housing 3 to reset it for subsequent use.

Figure 2:
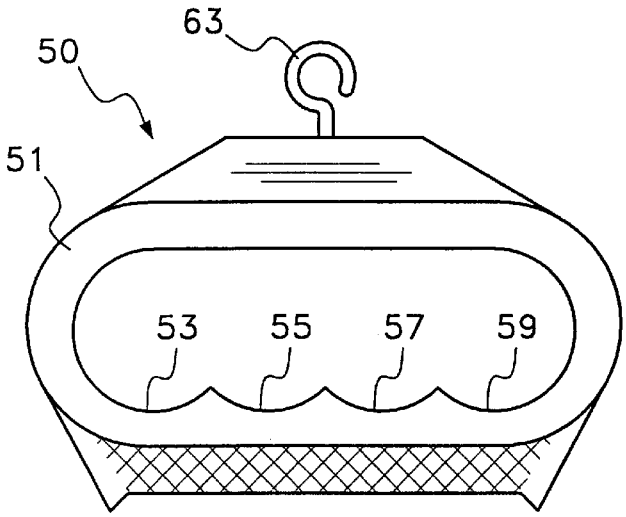
FIG. 2 shows a front view of a present invention hand auxiliary component for use in conjunction with a component shown in FIG. 1.

FIG. 2 shows one type of hand auxiliary component 50 used in the present invention device. Component 50 includes a handle member 51 with optional finger grooves 53, 55, 57 and 59 and grip 61 as shown. On the opposite side is hook 63 for attachment to ring 27 of man ratchet component 1 of FIG. 1. When main ratchet component 1 and hand auxiliary component 50 are connected to one another, a user may hold handle 7 in one hand and component 50 in the other hand, and while holding the device as such, may move the hands overhead and behind the back with the arm of the hand of handle 7 outstretched. The user may then repeatedly compress the ratchet-up 9 to shorten the distance of second end 23 and housing 3 to effect arm and upper body stretching. Depression of release button 29 will release the tension when the user has completed the stretching exercises.

The ring 27 and hook 63 shown in FIGS. 1 and 2 could easily be substituted with any known attachment/detachment mechanism without exceeding the scope of the present invention. Likewise the particular handle design, ratchet-up mechanism and release mechanism could be designed in a different fashion or placed in a different position without exceeding the scope of the present invention.

Figure 3:
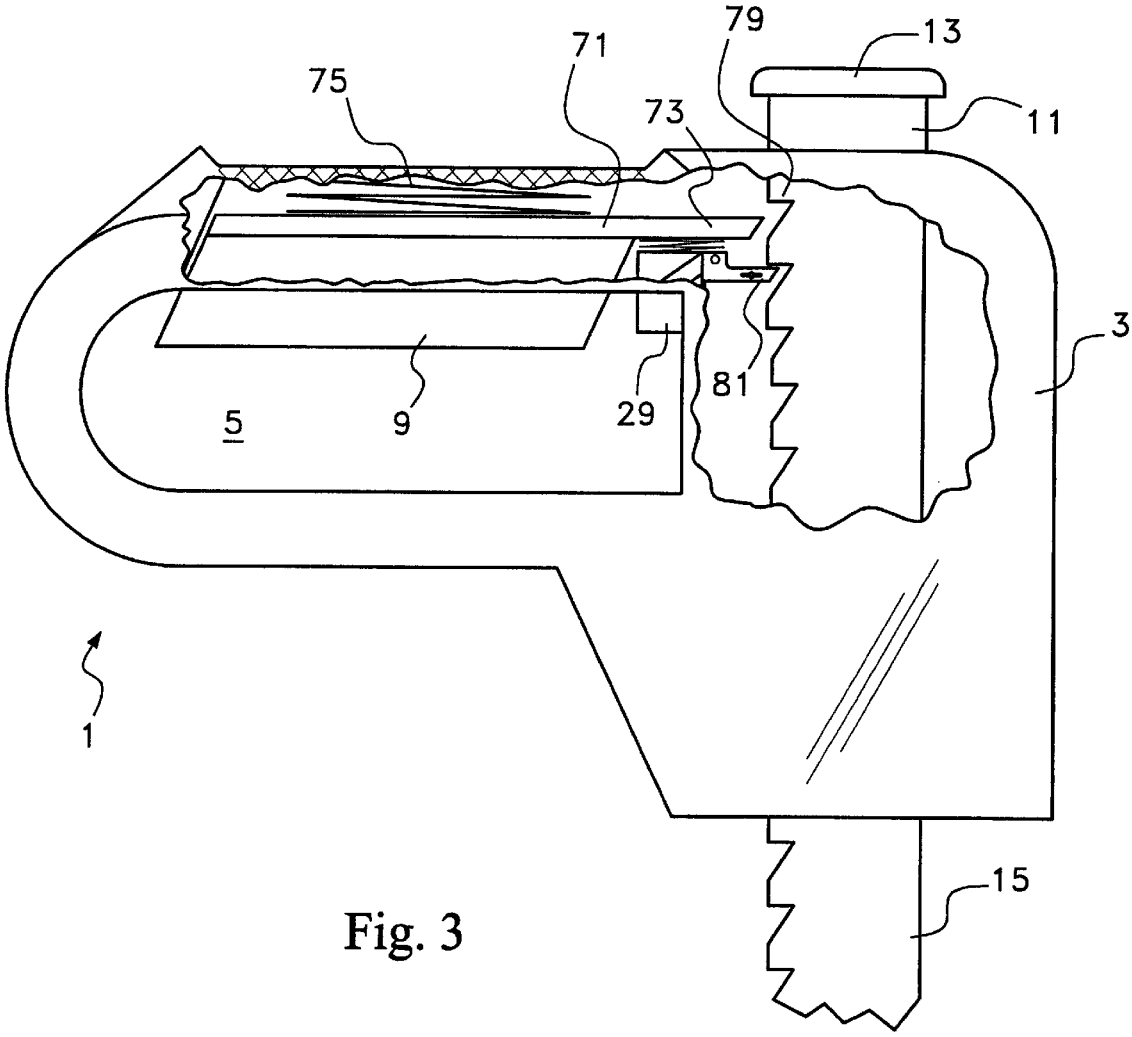
FIG. 3 shows a partially cut partial view of the main ratchet component shown in FIG. 1, but illustrating internal mechanical features.

FIG. 3 shows greater detail of the working mechanism of main ratchet component 1 shown in FIG. 1, and identical parts are identically numbered. In FIG. 3, ratchet-up bar 9 is shown in this partically cut view to include a lift rod 71 which is securely attached to or integrally formed as a part of ratchet-up bar 9.

Lift rod 71 has a lift protrusion 73 which is adapted to move into ratchet notches of bar 15 and advance ratchet bar 15 a ratchet notch with each compression. Spring 75 maintains ratchet-up bar 9 in its downward position. When ratchet-up bar 9 is pulled upwardly to compress spring 75, rod 71 and protrusion 73 move upwardly and to the right and will engage a notch such as notch 79 of bar 15 to advance bar 15 one notch, as described. This effects significant stretching when used as described above. Release button 29 moves lock 81 out of place to release tension and permit resetting of bar 15.

Figure 4:
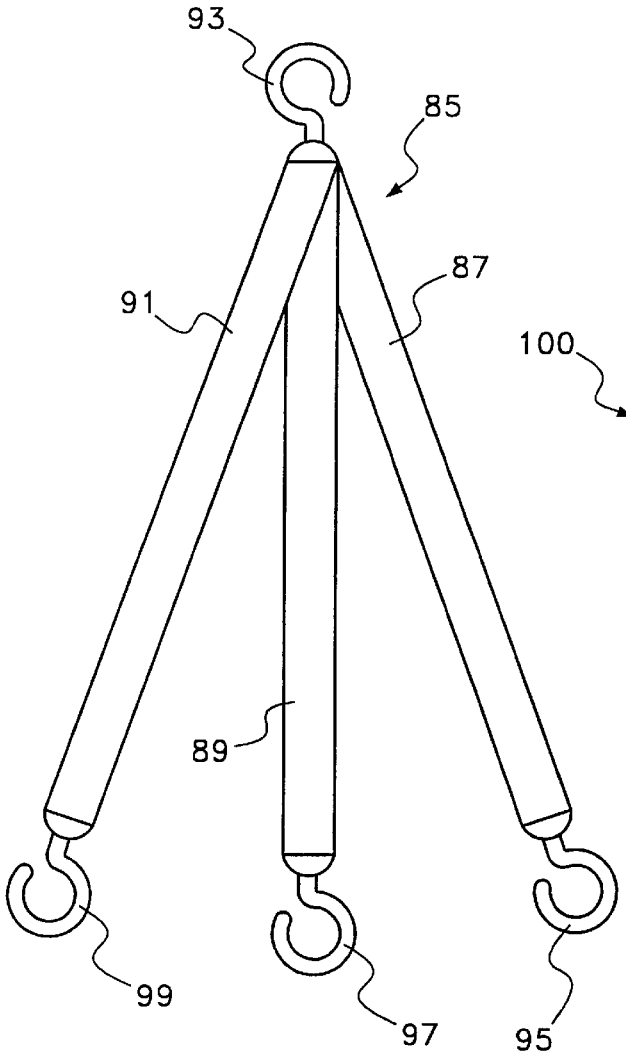
FIG. 4 illustrates an interconnecting yoke which is an optional component utilized in the present invention.

FIG. 4 illustrates a yoke 85, which is sometimes used in connection with an auxiliary foot component, but may be used with an auxiliary hand component (such as for extra reach) or could even be attached to a wall eyelet for other exercises such as tilted upper arm and body exercises. Yoke 85 includes three separate elongated members 87, 89, and 91. They are connected to one another at the top end with hook 93 affixed thereto and with hook 95, 97, and 99 at the opposite ends. Elongated members, 87, 89, and 91 may be flexible or rigid, but if rigid, should be hingeable at hook 93. Further details on yoke 85's uses are set forth below.

Figure 5:
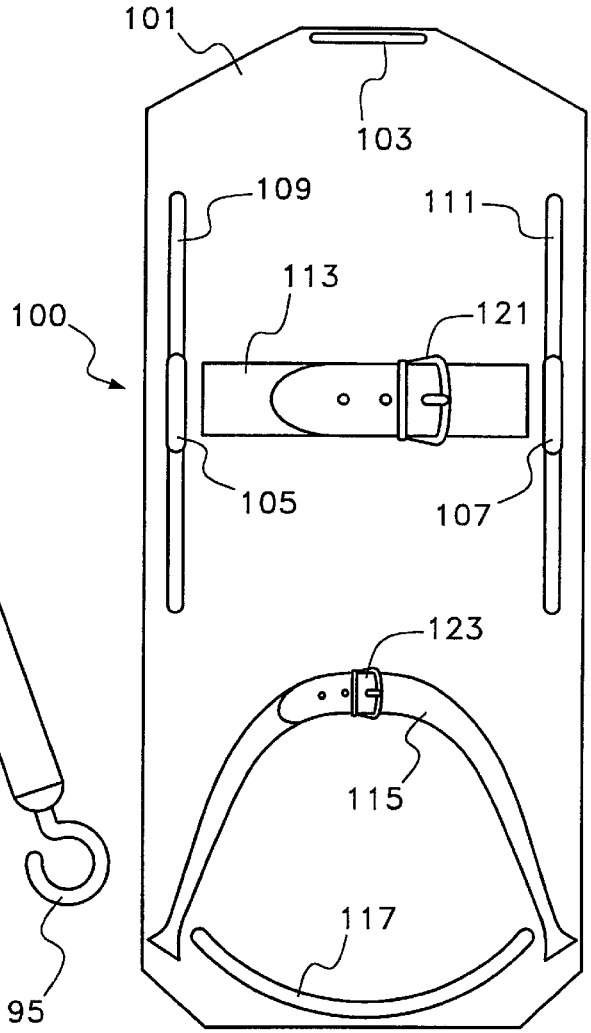
FIGS. 5 and 6 show a top view and a partial, cut rear view of one preferred embodiment of the present invention auxiliary foot component.
Figure 6:
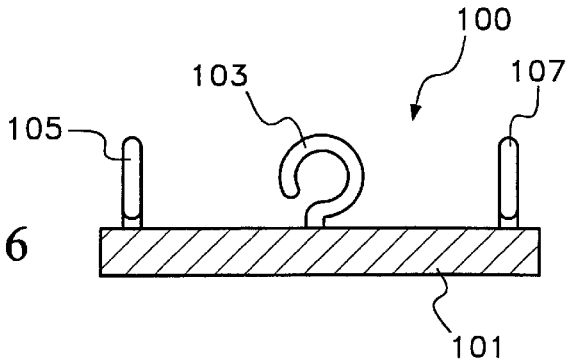

FIGS. 5 and 6 show a top and cut end view, respectively, of an auxiliary foot component 100 of the present invention. Identical parts are identically numbered in FIGS. 5 and 6. Auxiliary foot component 100 includes a rigid base 101 with a front hook 103 and side eyelets 105 and 107, opposing one another. Hook 103 is fixed and eyelets 105 and 107 are springloaded and adjustable by front or back movement in tracks 109 and 11, respectively. There is a set of foot straps 113 and 115, with buckles 121 and 123, as well as heel strap 117 for attachment to a foot. This foot mechanism is included for attachment of auxiliary foot component 100 to a foot, but any known attachment mechanism could be used without exceeding the scope of the present invention. For example, boots could be affixed to rigid base 101, instead of the straps. Alternatively, quick release buckles such as are used on skis or even the types of foot securing means found on water skis could be used.

Hook 103 may be attached directly to attachment ring 27 of main ratchet component 1 shown in FIG. 1 and by operating main ratchet component 1 to shorten the distance between ratchet bar second end 23 and housing 3, various leg and body stretching exercises are accomplished, such as hamstring stretches.

Alternatively, yoke 85 of FIG. 4 may be used as an interconnecting member between attachment ring 27 of FIG. 1 and hook 103 of FIG. 5.

For other exercises, hooks 95, 97, and 99 of yoke 85 of FIG. 4 may be attached to hook 103 and eyelets 105 and 107 of auxiliary foot component 100, to create a three-point hitch. For example, this arrangement may be used for spread eagle upper leg and abdominal exercises.

Figure 7:
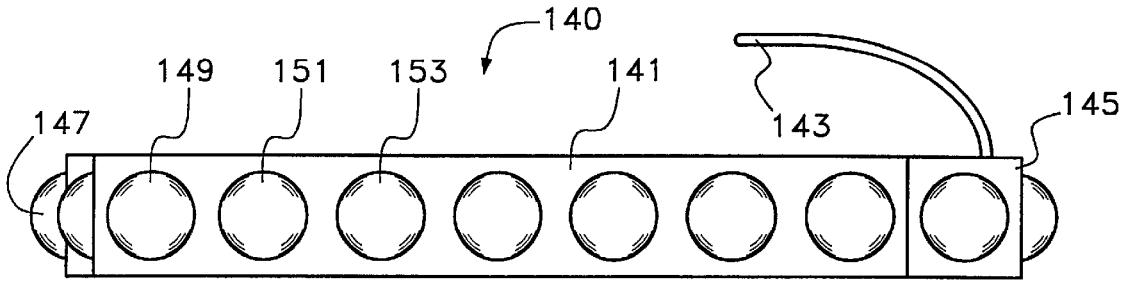
FIG. 7 shows a side partial view of an alternative embodiment auxiliary foot component of the present invention device.
Figure 8:
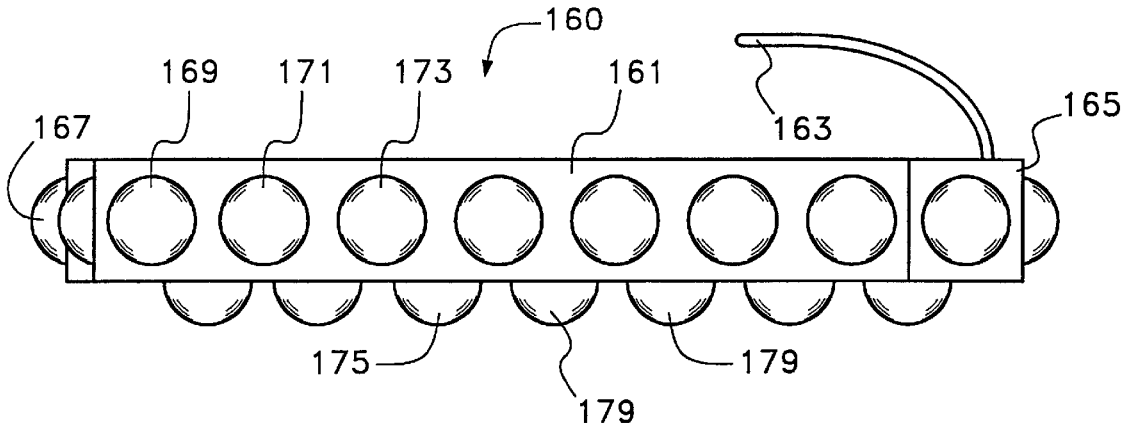
FIG. 8 shows a side partial view of another alternative embodiment auxiliary foot component of the present invention device; and, FIG. 9 shows a alternative preferred embodiment main ratchet component of a present invention device.

In one preferred embodiment of the present invention auxiliary foot component, wheels such as flat wheels or ball bearing wheels would be included in the walls and/or the bottom of the rigid base as illustrated in FIGS. 7 and 8.

Referring specifically to FIG. 7, FIG. 7 shows a partial side view of another embodiment present invention auxiliary foot component 140. The heal plate, straps and eyelets and hook described in conjunction with FIGS. 5 and 6 above are included in this embodiment, but are not shown in the figure to avoid confusion. Auxiliary foot component 140 includes a handle 143 and a plurality of side wheels around its periphery. In this case, these wheels are ballbearing wheels, but could be flat wheels, or any other type of wheels. Rigid base 41 has ballbearing wheels such as wheels 149, 151, and 153 along its side and similar wheels such as wheel 47 along its back, as well as along its front 145. These wheels enable a user to lay on his or her back or side and to move the auxiliary foot components with the heals, sides or toes in contact with a floor so as to smoothly roll therealong during exercises.

FIG. 8 shows another auxiliary foot component 160, which is the same as that described for FIG. 7 above except that wheels are also included on the underside or bottom. Thus, rigid base 161 has a handle 163 at its front 165 and wheels such as wheels 167, 169, 171 and 173 along its periphery. Bottom wheels are also included such as wheels 175, 177 and 179. Besides the uses described above with respect to FIG. 7, this component may be held at handle 163 and rolled around on a floor for arm and body exercises.

Figure 9:
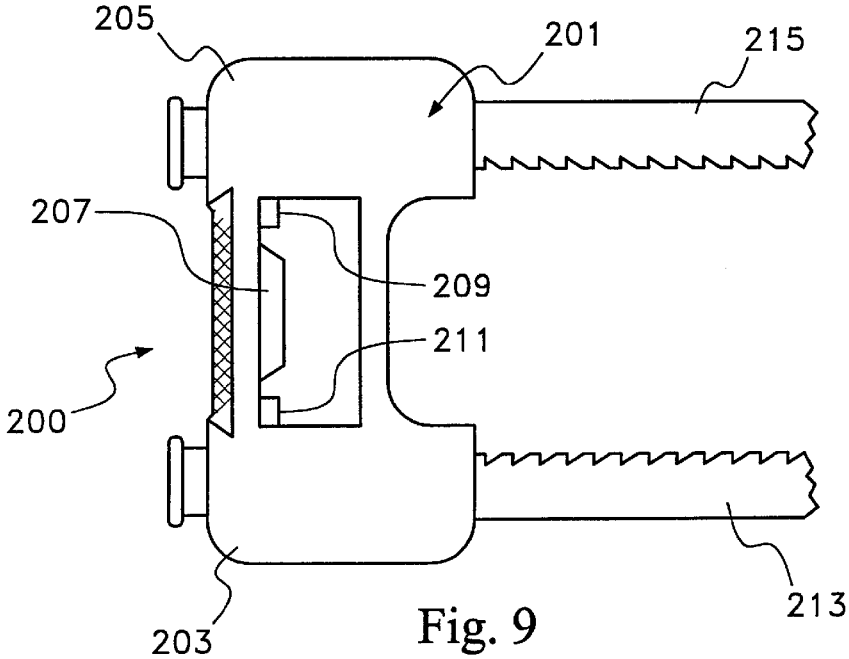

FIG. 9 shows an alternative embodiment present invention main ratchet component 200. In this case, it has two sets of ratchet bars instead of one. Housing 201 has a right side 203 and a left side 205. Each side has its own ratchet bar 213 and 215, respectively, with separate releases 209 and 211. Ratchet-up push bar 207 has internal travelers in both left and right directions to simultaneously advance ratchet bars 213 and 215. While this embodiment involves more parts and is more expensive to construct, it does offer more strength and balance than the preferred embodiment showed in FIGS. 1 and 3.

Obviously, numerous modifications and variations of the present invention are possible in light of the above teachings. It is therefore understood that within the scope of the appended claims, the invention may be practiced otherwise than as specifically described herein.

What is claimed is:

1. A modular component leg and body stretching device, which comprises:

(a) a main ratchet component having a handle and at least one ratchet bar functionally connected to and capable of passing through said handle, said handle containing a directional ratchet-up mechanism and a trigger wherein when said trigger is depressed, said at least one ratchet bar advances toward said handle, said handle also having a release mechanism to release said at least one ratchet bar from said ratchet-up mechanism, said ratchet bar having auxiliary component attachment means at one end thereof; and, (b) a foot auxiliary component attachable to said attachment means of said at least one ratchet bar for leg and body exercise, said foot auxiliary component having a rigid base for placement of a foot thereon, having foot securing means to hold said base to a foot and having at least one main ratchet component attachment means for attachment to said attachment means of said at least one ratchet bar.

2. The modular component leg and body stretching device of claim 1 wherein said securing means of said foot auxiliary component is a toe attachment means located on a front area of said rigid base.

3. The modular component leg and body stretching device of claim 1 wherein said securing means of said foot auxiliary component is two separate side attachment means, one being located on a first side of said rigid base and another being located on a second side of said rigid base, and located opposite one another.

4. The modular component leg and body stretching device of claim 1 wherein said securing means of said foot auxiliary component includes a toe attachment means located on a front area of said rigid base and at least two separate side attachment means, one being located on a first side of said rigid base and another being located on a second side of said rigid base, and located opposite one another.

5. The modular component leg and body stretching device of claim 4 wherein which further includes:

(a) a yoke having three separate elongated members, each having a first and a second end and being connected to one another at said first end and having means for attachment to said main ratchet component said first end, and each being unconnected to one another at said second end.

6. The modular component leg and body stretching device of claim 1 wherein said main ratchet component has two parallel ratchet bars.

7. The modular component leg and body stretching device of claim 1 wherein one of said auxiliary component attachment means and said main ratchet component attachment means is an eyelet and the other is a hook adapted to connect to said eyelet.

8. The modular component leg and body stretching device of claim 1 wherein said foot auxiliary component further includes a handle extended over a portion of a top of said component, and a plurality of wheels on its underside thereof for handle-held prone arm and body exercises.

9. The modular component leg and arm body stretching device of claim 8 wherein said plurality of wheels is a plurality of ball bearing wheels adopted to permit X and Y direction motion.

10. A modular component arm and body stretching device, which comprises:

(a) a main ratchet component having a handle and at least one ratchet bar functionally connected to and capable of passing through said handle, said handle containing a directional ratchet-up mechanism and a trigger wherein when said trigger is depressed, said at least one ratchet bar advances toward said handle, said handle also having a release mechanism to release said at least one ratchet bar from said ratchet-up mechanism, said ratchet bar having auxiliary component attachment means at one end thereof; and, (b) a hand auxiliary component attachable to said attachment means of said at least one ratchet bar for arm and body exercises, said hand auxiliary component having a handle for placement of a hand thereon and having at least one main ratchet component attachment means for attachment to said attachment means of said at least one ratchet bar.

11. The modular component arm and body stretching device of claim 10 wherein said hand auxiliary component includes a handle, a rigid brace member connected to said handle and at least one attachment means connected to said rigid brace member for attachment to said attachment means of said at least one ratchet bar.

12. The modular component arm and body stretching device of claim 10 wherein one of said auxiliary component attachment means and said main ratchet component attachment means is an eyelet and the other is a hook adapted to connect to said eyelet.

13. A modular component leg, arm, and body stretching device, which comprises:

(a) a main ratchet component having a handle and at least one ratchet bar functionally connected to and capable of passing through said handle, said handle containing a directional ratchet-up mechanism and a trigger wherein when said trigger is depressed, said at least one ratchet bar advances toward said handle, said handle also having a release mechanism to release said at least one ratchet bar from said ratchet-up mechanism, said ratchet bar having auxiliary component attachment means at one end thereof;

(b) a foot auxiliary component attachable to said attachment means of said at least one ratchet bar for leg and body exercise, said foot auxiliary component having a rigid base for placement of a foot thereon, having foot securing means to hold said base to a foot and having at least one attachment means for attachment to said attachment means of said at least one ratchet bar; and, (c) a hand auxiliary component attachable to said attachment means of said at least one ratchet bar for arm and body exercises, said hand auxiliary component having a handle for placement of a hand thereon and having at least one main ratchet component attachment means for attachment to said attachment means of said at least one ratchet bar.

14. The modular component leg, arm, and body stretching device of claim 13 wherein said security means of said foot auxiliary component is a toe attachment means located on a front area of said rigid base.

15. The modular component leg, arm, and body stretching device of claim 13 wherein said securing means of said foot auxiliary component is two separate side attachment means, one being located on a first side of said rigid base and another being located on a second side of said rigid base, and located opposite one another.

16. The modular component leg, arm, and body stretching device of claim 13 wherein said securing means of said foot auxiliary component includes a toe attachment means located on a front area of said rigid base and at least two separate side attachment means, one being located on a first side of said rigid base and another being located on a second side of said rigid base, and located opposite one another.

17. The modular component leg, arm, and body stretching device of claim 16 wherein which further includes:

(d) a yoke having three separate elongated members, each having a first and a second end and being connected to one another at said first end and having means for attachment to said main ratchet component said first end, and each being unconnected to one another at said second end.

18. The modular component leg, arm, and body stretching device of claim 13 wherein one of said auxiliary component attachment means and said main ratchet component attachment means is an eyelet and the other is a hook adapted to connect to said eyelet.

19. The modular component leg, arm, and body stretching device of claim 13 wherein said foot auxiliary component further includes a handle extended over a portion of a top of said component, and a plurality of wheels on its underside thereof for handle-held prone arm and body exercises.

20. The modular component leg, arm, and body stretching device of claim 13 wherein said hand auxiliary component includes a handle, a rigid brace member connected to said handle and at least one attachment means connected to said rigid brace member for attachment to said attachment means of said at least one ratchet bar.

* * * * *